United States Patent [19]

Takamatsu

[11] 4,000,546

[45] Jan. 4, 1977

[54] SLIDER FOR CONCEALED SLIDE FASTENERS

[75] Inventor: Ikuo Takamatsu, Uozu, Japan

[73] Assignee: Yoshida Kogyo Kabushiki Kaisha, Japan

[22] Filed: Sept. 23, 1975

[21] Appl. No.: 615,844

[30] Foreign Application Priority Data

Sept. 30, 1974 Japan ..... 49-118759[U]

[52] U.S. Cl. ..... 24/205.1 R; 24/205.15 R

[51] Int. Cl.[2] ..... A44B 19/32

[58] Field of Search ..... 24/205.1 R, 205.1 C

[56] References Cited

UNITED STATES PATENTS

| | | | |
|---|---|---|---|
| 2,120,924 | 6/1938 | Stillschweig | 24/205.1 R |
| 2,870,507 | 1/1959 | Poux | 24/205.15 R |
| 3,005,247 | 10/1961 | Doelter | 24/205.1 R |
| 3,011,251 | 12/1961 | McNamara | 24/205.1 R |
| 3,430,304 | 3/1969 | Swainson | 24/205.1 C |
| 3,798,715 | 3/1974 | Moertel | 24/205.1 R |

FOREIGN PATENTS OR APPLICATIONS

| | | | |
|---|---|---|---|
| 1,365,042 | 10/1967 | France | 24/205.1 R |
| 372,624 | 12/1923 | Switzerland | 24/205.1 R |
| 489,657 | 8/1938 | United Kingdom | 24/205.1 R |
| 495,227 | 11/1938 | United Kingdom | 24/205.1 R |

*Primary Examiner*—Bernard A. Gelak
*Attorney, Agent, or Firm*—Bucknam and Archer

[57] ABSTRACT

A slider for use with a pair of concealed fastener stringers in which rows of scoops are stitched to respective folds formed rearwardly along the opposed longitudinal edges of stringer tapes, in such a manner that each tape fold has a loose outermost edge on the outside of the line of stitching. A pair of side walls on the marginal edges of the rear wall of the slider body extend from its lower end and terminate short of its upper end, and a pair of outer lips turned inwardly from the side walls extend close to the lipped inboard end of a separator on the upper end of the rear wall. The slider of this configuration is capable of preventing the jamming of the loose outermost edges of the tape folds as they enter the guide channel in the slider body during the fastener closing movement of the slider.

2 Claims, 5 Drawing Figures

SLIDER FOR CONCEALED SLIDE FASTENERS

BACKGROUND OF THE DISCLOSURE

This invention relates generally to slide fasteners and in particular to concealed slide fasteners. More particularly, the invention is directed to the provision of an improved slider for concealed slide fasteners of the type in which matingly interengageable rows of fastener elements or scoops are stitched to respective folds formed rearwardly along the confronting longitudinal edges of stringer tapes.

In the concealed slide fasteners of the type under consideration (shown in FIG. 1 of the accompanying drawings), the rearward folds of the stringer tapes have loose outermost edges located on the outside of the stitching lines. When the slider of known configuration is moved along the scoops in the fastener closing direction, the outermost edges of the tape folds are easy to jam within the usual guide channel of the slider body. Such jamming of the loose outmost edges of the tape folds offers considerable resistance to the fastener closing movement of the slider, as will be later explained in further detail.

SUMMARY OF THE INVENTION

It is a principal object of this invention to provide an improved slider for use in a concealed slide fastener of the above defined type, so made that during the fastener closing movement of the slider, the loose outermost edges of stringer tape folds can be guided properly into the guide channel of the slider body without any possibility of jamming, thereby affording smooth slider movement.

Briefly, the invention provides a slider including a rear wall having a separator formed centrally at its upper end. The separator has a pair of inner lips at its inboard or lower end and the usual pull tab pivotally coupled thereto. The rear wall has formed along its respective marginal edges a pair of side walls or flanges which extend from the lower end of the rear wall and terminate short of its upper end. A pair of outer lips extending inwardly from the respective side walls have their upper ends arranged slightly upwardly of the lipped inboard end of the separator. These outer lips have inside corners at their upper ends which are opposed to the respective inner lips and which are each spaced therefrom a distance only slightly in excess of the thickness of each stringer tape.

Since the lipped side walls extending from the lower end of the rear wall terminate short of its upper end, the rear wall has shoulder portions at its upper end which are left uncovered by the lipped side walls. Thus, as the rows of scoops ride onto these shoulder portions during the fastener closing movement of the slider, each stringer tape will experience a crosswise or transverse pull which is effective to keep the aforesaid loose outermost edge of the tape fold out of contact with the corresponding outer lip. Furthermore, since the upper inside corners of the outer lips are arranged sufficiently close to the respective inner lips at the inboard end of the separator, the loose outermost edges of the tape folds are not to be caught by these corners of the outer lips. The slider according to the invention is therefore capable of sliding smoothly along the rows of scoops to couple or uncouple the same.

The features which are believed to be novel and characteristic of this invention are set forth in particular in the appended claims. The invention itself, however, both as to its configuration and manner of functioning, together with the additional objects and advantages thereof, will become apparent as the description proceeds, with reference had to the accompanying drawings in which like reference characters refer to the corresponding parts of the several views.

DESCRIPTION OF THE PREFERRED EMBODIMENT

Figure 1:
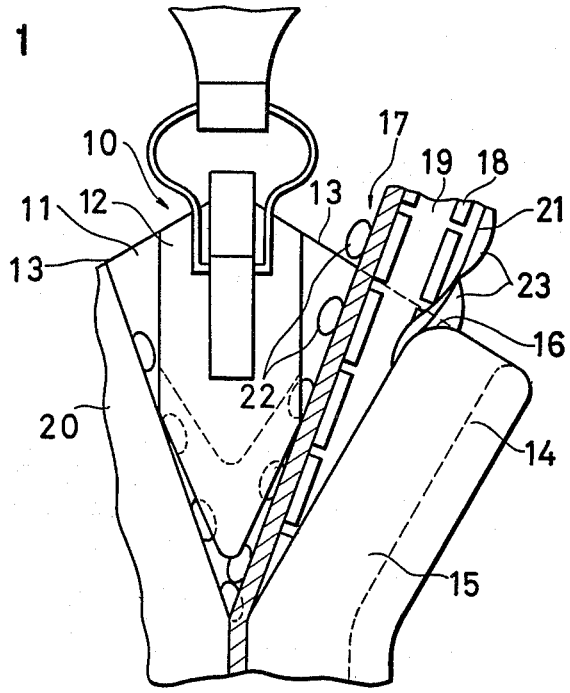
FIG. 1 is a fragmentary front view of a typical prior art concealed slide fastener, in which one of the stringer tapes is shown partly cut away to manifest the way the loose outermost edge of its rearward fold jams within the sider body during slider movement in the fastener closing direction.

It will redound to the full appreciation of this invention to illustrate and describe in some more detail a typical example of prior art sliders for concealed slide fasteners of the type in question. With reference therefore to FIG. 1 the exemplified prior art slider 10 includes a rear wall 11 which has an island or separator 12 formed centrally at its flared upper end and a pair of relatively wide shoulders 13 on both sides of the separator. A pair of side walls or flanges 14 extend along, and throughout the length of, the marginal edges of the rear wall 11. Each side wall 14 has a lip 15 turned inwardly therefrom, and each lip has a rounded inside corner 16 at its upper end.

The prior art slider 10 of the foregoing configuration is intended for use with a pair of fastener stringers in which a chain, roll or series of fastener elements or scoops 17 is stitched at 18 to each of rearward folds 19 formed along the confronting longitudinal edges of stringer tapes 20. When the prior art slider 10 is installed on the fastener stringers as shown in FIG. 1, the upper inside corner 16 of each lip 15 directly overlies the outermost edge 21 of the fold 19 of the corresponding stringer tape 20. This outermost edge 21 of each tape fold 19 is, of course, merely loosely urged against the scoops 17 by the stitches 18.

Thus, when the prior art slider 10 is pulled along the scoops 17 in the fastener closing direction, that is, upwardly as viewed in FIG. 1, the loose outermost edge 21 of each stringer tape fold 19 is easy to ride over the corner 16 of the corresponding slider lip 15. This is particularly liable to occur when the scoops 17 are subjected to torsional forces tending to turn their coupling heads 22 toward the slider rear wall 11 and their connective bight portions 23 toward each slider lip 15.

Figure 2:
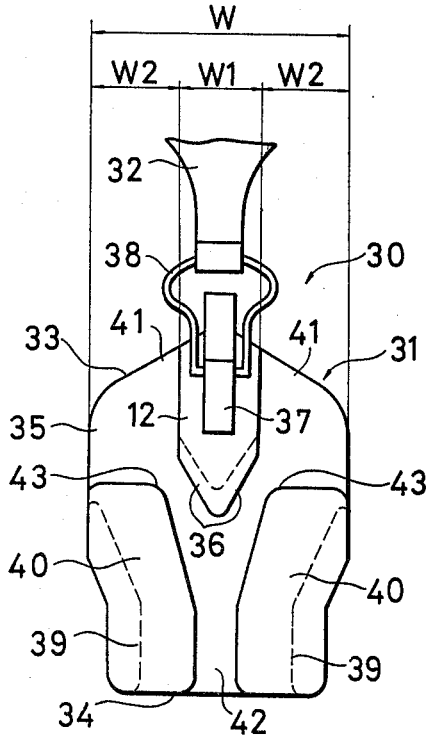
FIG. 2 is a front view of a preferred form of the slider according to this invention.

As the prior art slider 10 is further forcibly pulled in the fastener closing direction, the corner 16 of each lip 15 may function as a guide to cause the loose outermost edge 21 of the corresponding tape fold 19 to rise away from the scoops 17 and to jam under the slider lip. This jamming of the outermost edge 21 can significantly increase resistance to the fastener closing movement of the slider along the scoops 17, to the extent of eventually locking the slider against movement. FIG. 2 illustrates the configuration of a preferred form of the slider according to this invention, which is designed to eliminate the above explained defects of the prior art. The illustrated slider 30 according to the invention broadly comprises a body 31 and pull tab 32. The slider body 31 has a widened upper end 33 and contracted lower end 34. The separator 12 is arranged centrally at the upper end of a rear wall 35 constituting the principal part of the slider body 31. A pair of inner lips 36 are formed at the inboard or lower end of the separator 12 so as to take, in combination, the shape of a V. A lug 37 is formed atop the separator 12, and the pull tab 32 is pivotally coupled to this lug via a connector ring 38.

As will be seen by referring back to FIG. 1, the slider construction as hereinbefore described in connection with FIG. 2 is largely conventional, and therein lies no feature of this invention. The inventive concepts are embodied in the parts, arrangements and relative dimensions set forth in the following.

Figure 3:
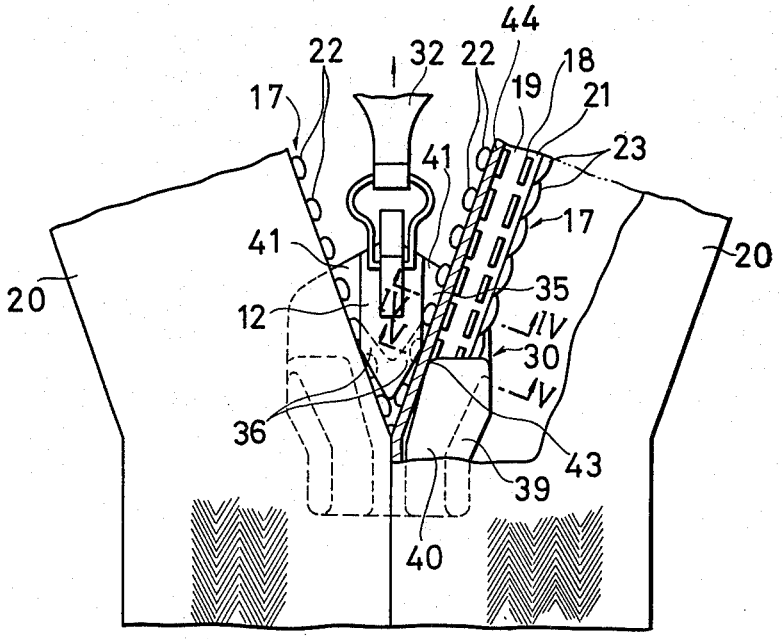
FIG. 3 is a fragmentary front view of a concealed slide fastener incorporating the slider of FIG. 2, in which one of the stringer tapes is shown partly cut away as in FIG. 1.

According to this invention the width W of the rear wall 35 of the slider 30 at its upper end 33 is made approximately equal to the sum of the width *w*1 of the separator 12 and twice the width *w*2 of each chain, roll or series of fastener elements or scoops 17, FIG. 3, of the fastener stringers for use with the slider 30.

A pair of side walls or flanges 39 are formed along the marginal edges of the rear wall 35. It should be noted that these side walls 39 extend from the lower end 34 of the bottom wall 35 and terminate short of its upper end 33. A pair of outer lips 40 turn inwardly from the side walls 39 and are arranged in coplanar relationship to each other. These outer lips have a spacing therebetween to provide an avenue through which the folds 19 of the stringer tapes 20 extend.

The upper ends of the outer lips 40, which are parallel to the lower end 34 of the rear wall 35, are located only slightly upwardly of the lipped inboard end of the separator 12. The rear wall 35 therefore has the shoulder portions 41 which are left uncovered by the outer lips 40 or by the side walls 39. The aforesaid separator 12 with its inner lips 36, side walls 39 and outer lips 40 cooperate to define a generally Y-shaped guide channel 42 on the rear wall 35.

Figure 5:
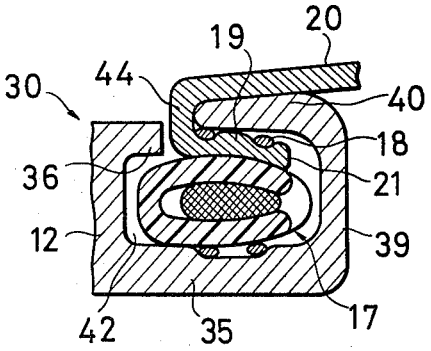
FIG. 5 is also an enlarged, partial sectional view taken along the plane of line V—V in FIG. 3.

As will be best understood from a consideration of FIGS. 3 and 5, the spacing between the upper, inside corner 43 of each outer lip 40 and the opposed inner lip 36 is made only slightly greater than the thickness of each stringer tape 20 at its folding line 44. That is to say, the corner 43 of each outer lip 40 considerably extends inwardly beyond the loose outermost edge 21 of the corresponding stringer tape fold 19 passing under the upper end of the outer lip.

It will be noted from FIG. 3 that the fastener stringers for use with the slider 30 according to this invention are of exactly the same organization as those shown in FIG. 1. It may be worth mentioning, however, that the scoops 17 stitched to the rearward fold 19 of each stringer tape 20 are of the conventional coil type, with each scoop formed by one of the turns of the coil. The scoops 17 have the coupling heads 22 for mating engagement between similar coupling heads of the complementary row of scoops, and a pair of shanks 45 extending rearwardly or outwardly from each coupling head are connected to the adjacent scoops via the bight portions 23.

In the use of the complete slide fastener according to the invention, the Y-shaped guide channel 42 of the slider body 31 accommodate the rows of scoops 17 together with the folds 19 of the stringer tapes 20, as shown in FIG. 3. It is noteworthy that the loose outermost edges 21 of the tape folds 19 are located sufficiently close to the respective side walls 39 of the slider body 31, far from the upper inside corners 43 of the outer lips 40.

If now the slider 30 is pulled along the rows of scoops 17 in the fastener closing direction, as indicated by the arrow in FIG. 3, a transverse pull will be exerted on each stringer tape 20 as the scoops thereon are about to move relatively into the guide channel 42 of the slider body 31. Since the shoulder portions 41 of the slider rear wall 35 are left uncovered by the outer lips 40 or side walls 39 as aforesaid, the transverse pull will cuase the coupling heads 22 of the scoops 17 to turn away from the rear wall, and the bight portions 23 of the scoops to turn toward the rear wall, as the scoops ride onto the shoulder portions, as best illustrated in FIG. 4.

Figure 4:
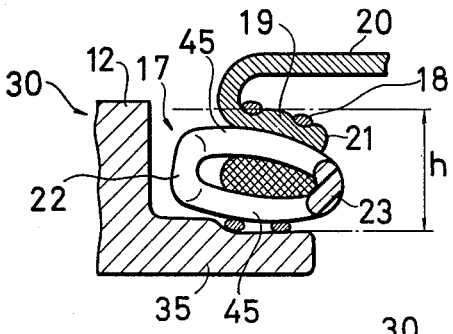
FIG. 4 is an enlarged, partial sectional view taken along the plane of line IV—IV in FIG. 3.

As a consequence, the loose outermost edge 21 of each tape fold 19 will become lower than the height *h*, FIG. 4, of the inside surface of each outer lip 40 above the slider rear wall 35. The soops 17 with the tape folds 19 can thus be guided properly under the outer lips 40 in that slanting disposition of FIG. 4. There is absolutely no possibility of the loose outermost edges 21 of the tape folds 19 riding over the corners 43 of the outer lips 40, because these lip corners are arranged sufficiently close to the inner lips 36 on the separator 12.

The scoops 17 that have passed into the guide channel 42 in the above described manner are then readjusted by the inner lips 36 into the correct disposition as shown in FIG. 5. The scoops subsequently emerge coupled together out of the contracted lower end 34 of the slider body 31.

While the slider for concealed slide fasteners according to this invention has been shown and described hereinbefore in terms of its preferred form, it is understood that the invention itself is not to be restricted by the exact showing of the accompanying drawings or the description thereof, as many modifications will readily occur to the specialists on the basis of this disclosure. It is therefore appropriate that the invention be construed broadly and in a manner consistent with the fair meaning or proper scope of the following claims.

What is claimed is:

1. In a concealed slide fastener of the type wherein a pair of stringer tapes have rearward folds formed along their confronting longitudinal edges to support respective rows of scoops thereon, a slider movable along said rows of scoops for coupling and uncoupling the same, said slider comprising, in combination: a rear wall having a separator formed centrally at its upper end, said separator having a pair of inner lips formed at its inboard end and a pull tab pivotally coupled thereto; a pair of side walls extending along the respective marginal edges of said rear wall from its lower end and terminating short of its upper end; and a pair of outer lips extending toward each other from said side walls, respectively, and having upper ends arranged slightly upwardly of the inboard end of said separator, said upper end of each outer lip having an inside corner opposed to one of said inner lips and spaced therefrom a distance slightly in excess of the thickness of each stringer tape to engage the stringer tape at the rearward folding line thereof in overlying relation to the rearward fold portion of the stringer tape.

2. The slider as set forth in claim 1, wherein said rear wall has a pair of surface portions, each surface portion adjoining and extending along a corresponding side of said separator, each surface portion having a width approximately equal to the width of each row of scoops.

* * * * *